United States Patent [19]

Johnson

[11] 4,313,692

[45] Feb. 2, 1982

[54] SEPTIC TANK DRAINAGE CONDUIT STRUCTURES

[76] Inventor: Wayne D. Johnson, 902 N. 4th, Garden City, Kans. 67846

[21] Appl. No.: 115,693

[22] Filed: Jan. 28, 1980

[51] Int. Cl.[3] ..... E02B 11/00; E02B 13/00

[52] U.S. Cl. ..... 405/43; 405/46

[58] Field of Search ..... 405/43–46, 405/36; 210/170

[56] References Cited

U.S. PATENT DOCUMENTS

| | | | |
|---|---|---|---|
| 994,155 | 6/1911 | Harris | 405/43 |
| 1,220,891 | 3/1917 | Reed et al. | 405/47 |
| 2,674,337 | 4/1954 | Noe | 405/47 X |
| 2,802,339 | 8/1957 | Fogerty | 405/47 |
| 3,579,995 | 5/1971 | Flynn | 405/46 |
| 3,698,194 | 10/1972 | Flynn | 405/36 |
| 3,919,848 | 11/1975 | Sullivan | 405/43 |
| 4,192,628 | 3/1980 | Gorman | 405/45 |

*Primary Examiner*—Stephen J. Novosad

*Attorney, Agent, or Firm*—Phillip A. Rein

[57] ABSTRACT

This invention is in regard to septic tank drainage conduit structures, including an open-sided conduit structure for installation in clay type soil conditions and a U-shaped conduit structure for use in loose or sandy soil conditions. Each conduit structure is constructed of an integral material and of a large size to achieve maximum absorption of waste septic fluid into the surrounding soil area. Each conduit structure is supported on leg members with a completely open bottom area between the leg members to achieve maximum waste water absorption downwardly from each conduit structure.

3 Claims, 7 Drawing Figures

SEPTIC TANK DRAINAGE CONDUIT STRUCTURES

PRIOR ART

A search of the prior art for a septic tank system with an irrigation system combined revealed only the following patents pertinent to this application, being U.S. Pat. Nos. 2,802,339 and 3,698,194.

The Fogerty septic tank drain line is shown in various embodiments but the individual conduit members are substantially different in appearance and usage when compared to the invention described herein.

The Flynn patent teaches the use of a single discharge pipe leading into adjacent leaching canals.

PREFERRED EMBODIMENTS OF THE INVENTION

This invention relates to septic tank drainage conduit structures to be connected to conventional septic tank structures and convey waste waters therefrom instead of the use of four inch (4") diameter tile sections supported on a gravel base. A pair of embodiments of the septic tank drainage conduit structures are disclosed herein, being: (1) an open-sided conduit structure; and (2) a U-shaped conduit structure. The open-sided conduit structure is designed for use in solid clay soil conditions having (1) a main body assembly, (2) transfer members secured to the main body assembly for movement thereof, and (3) a septic inlet piping assembly connected to conduit structures to convey waste water from the septic tank thereto. The main body assembly includes a horizontal, top wall member supported on spaced support leg members. The area between the spaced support members is opened outwardly and a drainage hole in each support leg members permits absorption of waste fluid into the clay soil laterally and downwardly of the top wall member. The U-shaped conduit structure includes (1) a U-shaped main body assembly, (2) transfer members secured to the main body assembly, and (3) a septic inlet piping assembly connected to one of a plurality of aligned U-shaped conduit structures to convey waste water from the septic tank thereto. The main body assembly includes a top wall member supported by spaced, parallel support leg members. The support leg members are secured to outer edges of the top wall member and extended the length thereof and designed for use in sandy soil conditions. The support leg members are provided with spaced drainage holes to provide for absorption of the waste water laterally of the support leg members and downwardly thereof as no bottom wall is provided.

OBJECTS OF THIS INVENTION

One object of this invention is to provide septic tank drainage conduit structures mounted in large trenches and providing a large area for absorption of waste fluids into the surrounding soil.

Another object of this invention is to provide a conduit structure used in a septic tank system that is stable when installed and not requiring the use of expensive gravel for installation.

Still another object of this invention is to provide a conduit structure providing a large area of waste water absorption into surrounding soil area and designed for use in hard, clay soil conditions.

One other object of this invention is to provide a conduit structure providing a large area of waste water absorption into surrounding soil area and designed for use in loose dirt and sandy soil conditions.

One further object of this invention is to provide a conduit structure whereby a plurality of open-sided conduit structure embodiments are placed in an open trench in abutting alignment in place of the conventional use of four inch (4") diameter drainage tile members surrounded by gravel in order to achieve absorption in the surrounding soil.

A still further object of this invention is to provide a conduit structure of large size which is easy and economical to manufacture, can be installed in considerable lengths with a minimum amount of labor, permits a maximum area of waste water absorption into the surrounding soil, and being of sturdy construction for long life thereof.

Various other objects, advantages, and features of this invention will become apparent to those skilled in the art from the following discussion, taken in conjunction with the accompanying drawings, in which:

FIGURES OF THE INVENTION

Figure 1:
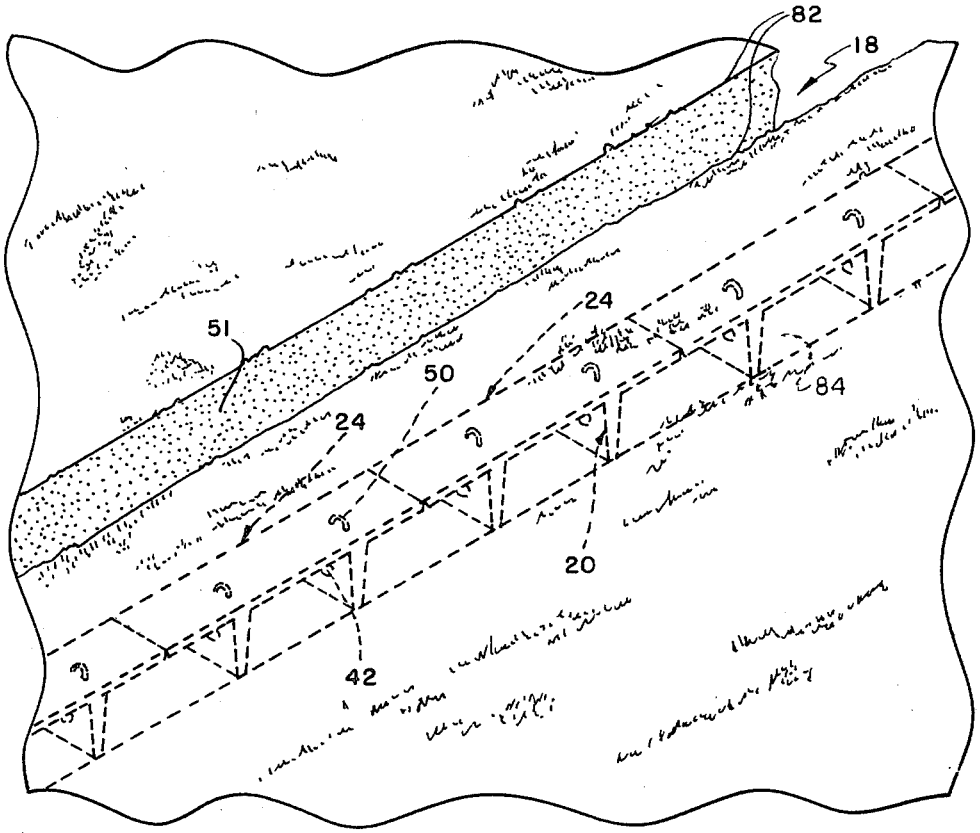
FIG. 1 is a perspective view of an aligned plurality of open-sided conduit structure embodiments of this invention as mounted in an open trench in the support soil.

The following is a discussion and description of preferred specific embodiments of the new septic tank drainage conduit structures of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

The septic tank drainage conduit structures 18 of this invention includes two similar embodiments being (1) an open-sided conduit structure 20; and (2) a U-shaped conduit structure 22. The open-sided conduit structure 20 includes a main body assembly 24, transfer members 26 secured to the main body assembly 24, and, in certain main body assemblies 24, a septic inlet piping assembly 28 connected to the main body assembly 24.

The main body assembly 24 is preferably constructed of a concrete material and includes a top wall member 30 without any openings therein except as will be explained mounted on spaced support leg members 32. The top wall member 30 includes a top wall support surface 33 integral with tapered end walls 34 and side walls 36 which, in turn, are integral with a bottom wall 38.

The spaced support leg members 32 extended transversly and perpendicular to the top wall member 30 includes a main support body 40 having a drainage hole 42 therethrough. The main support body 40 includes downwardly, inwardly inclined side walls 44 and end walls 46 which, in turn, are integral with a bottom support wall 48.

The transfer members 26 are U-shaped handle members 50 anchored in the top wall member 30 and used to transfer and set the conduit structure 20 in an open trench 51 as shown in FIG. 1.

Figure 2:
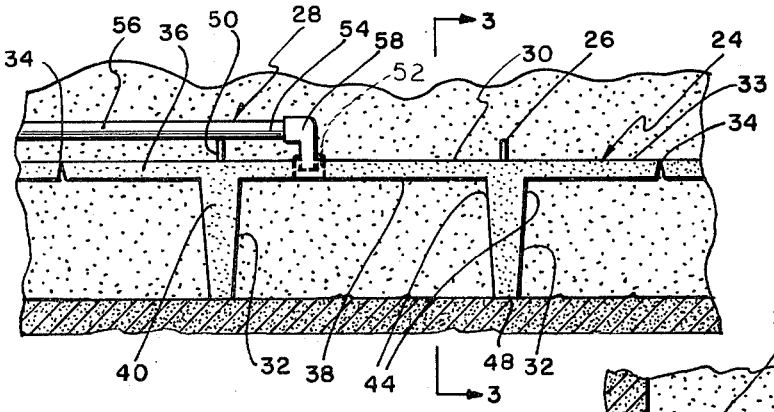
FIG. 2 is a fragmentary side elevational view of the open-sided conduit structure as shown in FIG. 1.

As seen in FIG. 2, the plurality of abutting open-sided conduit structures 20 are connected to a conventional septic tank (not shown) to a conduit structure by the septic inlet piping assembly 28 which includes a piping opening 52 in the top wall member 30 and a septic piping assembly 54 connected thereto.

The septic piping assembly 54 can be four inch (4") diameter plastic piping with a transfer pipe 56 secured to a 90° elbow 58 that is sealed and mounted in the piping opening 52.

Figure 4:
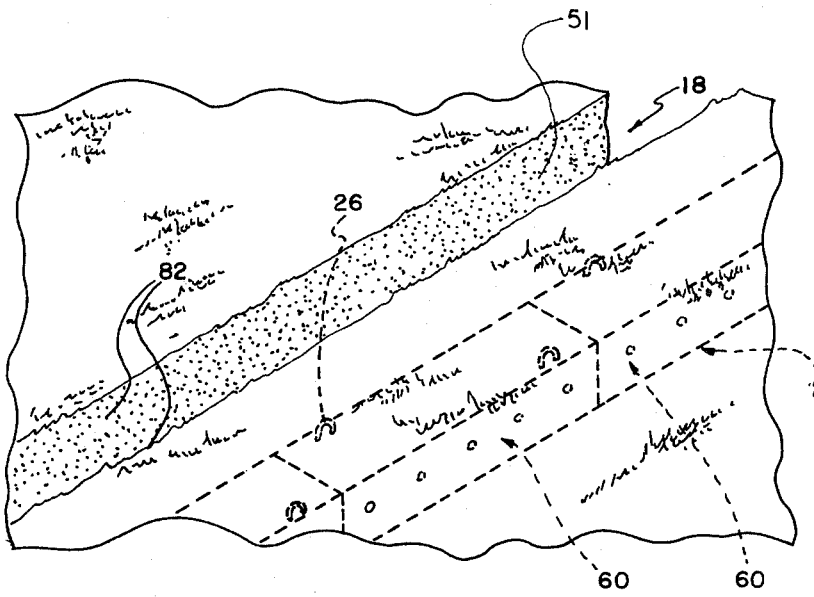
FIG. 4 is a perspective view similar to FIG. 1, illustrating the use of a U-shaped conduit structure of this invention as mounted in an open trench in the support soil.
Figure 5:
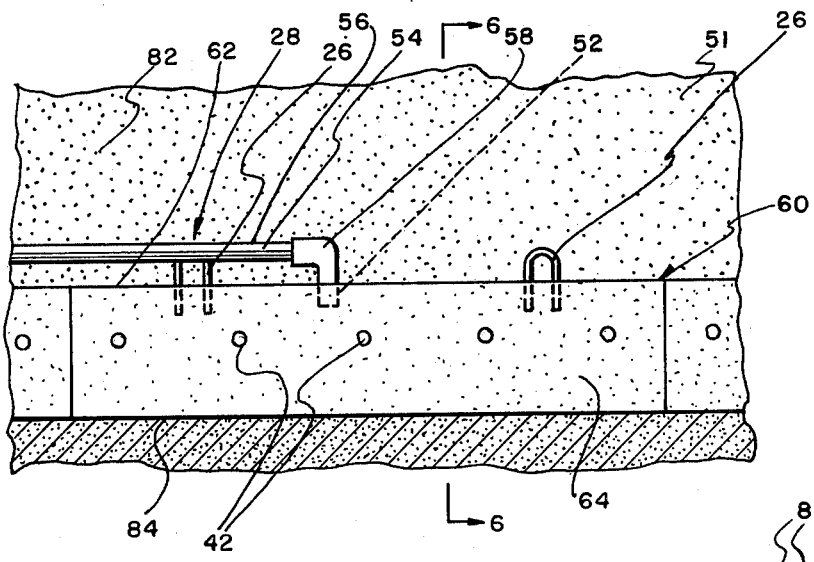
FIG. 5 is a fragmentary side elevational view of the U-shaped conduit structure as shown in FIG. 4.
Figure 7:
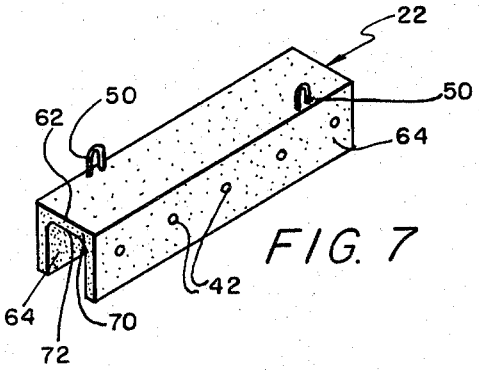
FIG. 7 is a perspective view of the U-shaped conduit structure of this invention.
Figure 6:
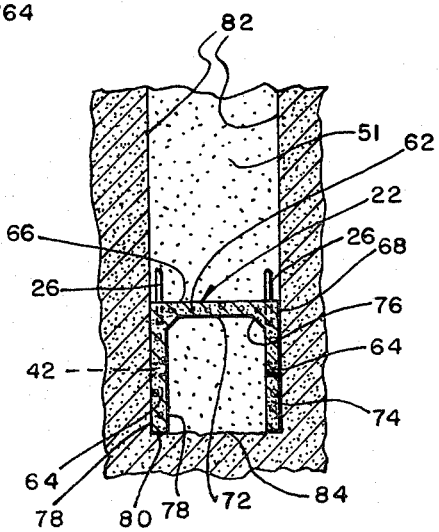
FIG. 6 is a fragmentary elevational view taken along line 6—6 in FIG. 5.

As shown in FIG. 4, a plurality of the U-shaped conduit structures 22 are placed in abutting relationship in an open trench 51 to convey and disperse waste water from a conventional septic tank (not shown). Each U-shaped conduit structure 22 includes a U-shaped main body assembly 60, transfer members 26 connected to the main body assembly 60 and, in certain main body assemblies 60, a septic inlet piping assembly 28 connected to the main body assembly 60.

The main body assembly 60 is preferably constructed of a concrete material and includes a top wall member 62 supported on spaced support leg members 64. The top wall member 62 is of generally elongated plate shape having a top wall 66 integral with side walls 68 and end walls 70 which, in turn, are integral with a bottom wall 72.

The spaced support leg members 64 are parallel to each other and integral with the top wall member 62 and extend the length of the respective opposed, parallel side walls 68.

Each spaced support leg member 64 includes vertical wall sections 74 connected through an inclined reinforcing section 76 to the top wall member 62 and a plurality of spaced drainage holes 42 in the vertical wall sections 74. The wall sections 74 have parallel wall portions 78 integral with a support bottom wall portion 80. Each vertical wall section 74 is shown with five (5) drainage holes 42 but can be increased or decreased depending on surrounding soil conditions.

The transfer members 26 are as described in the first embodiment with U-shaped handle members 50 anchored in the top wall member 62 for use in transfer of the entire conduit structure 22.

The septic inlet piping assembly 28 is identical to the first embodiment and includes the piping opening 52 in the top wall member 62 and the septic piping assembly 54 connected thereto. The septic piping assembly 54 includes the transfer pipe 56 secured to the elbow 58 which is sealed and mounted in the piping opening 52.

USE AND OPERATION OF THE INVENTION

The septic tank drainage conduit structures 18 of this invention are constructed in forms and preferably of concrete material. The conduit structures 18 are approximately two (2) feet in width and height with open bottom areas to achieve a considerable area of waste water absorption in the surrounding soil area. The conduit structures 18 are mounted in the respective trenches 51 at the proper calculated depth and operate very superior to the normal use of four inch (4") conduit tiles resting and surrounded by gravel material.

Figure 3:
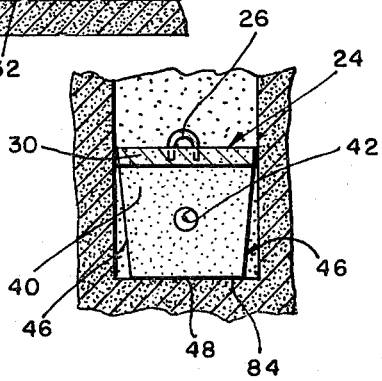
FIG. 3 is a fragmentary elevational view taken along line 3—3 in FIG. 2.

As shown in FIG. 1, the open-sided conduit structures 20 are placed in the trench 51 which allows waste water flow from the septic inlet piping assembly 28 between the support leg members 32, the drainage holes 42, and side walls 82 and bottom wall 84 of the trench 51. Also, longitudinal flow of the waste water goes around the inwardly inclined end walls 46 as shown in FIG. 3.

As shown in FIG. 4, the U-shaped conduit structures 22 are placed in abutting relationship in a respective open trench 51 at the calculated depth and location. The conduit structures 22 are designed to be used in loose or sandy soil conditions.

The waste water flow from the septic inlet piping assembly 28 flows between the support leg members 64 and is absorbed into the surrounding soil area through the drainage holes 42 and the bottom wall 84 of the trench 51.

The drainage conduit structures are of substantially large size for maximum water absorption, constructed in long lengths to save in installation time and labor, constructed of a material that will not deteriorate, and of a weight to prevent settling between relative abutting structures.

The drainage conduit structures replace the old system of clay tile conduit surrounded by the now expensive gravel and is far superior in length of maintenance free service and longevity of the system.

While the invention has been described in conjunction with preferred specific embodiments thereof, it will be understood that this description is intended to illustrate and not to limit the scope of the invention, which is defined by the following claims:

I claim:

1. A conduit structure to be placed in a trench adapted to be connected to a conventional septic tank structure to convey waste water therefrom for absorption into the soil area surrounding said conduit structure, comprising;

(a) said conduit structure having a main body assembly with a top wall member mounted on spaced support leg members;

(b) said support leg members having a drainage hole therein to permit waste water flow therethrough;

(c) said main body assembly having an open area between said support leg members and downwardly of a lower surface of said top wall member to permit free flow of waste water downwardly therefrom into the soil area; and (d) said support legs extended downwardly and perpendicular to said top wall member and transverse to the longitudinal axis of said top wall member, whereby the waste water can flow freely laterally of said top wall member starting at a position directly below a lower surface of said top wall member into the adjcent soil area which is of a generally solid clay type composition.

2. A conduit structure to be placed in a trench adapted to be connected to a conventional septic tank structure to convey waste water therefrom for absorption into the soil area surrounding said conduit structure, comprising;

(a) said conduit structure having a main body assembly with a top wall member mounted on spaced support leg members;

(b) said support leg members having a drainage hole therein to permit waste water flow therethrough;

(c) said main body assembly having an open area between said support leg members to permit free flow of waste water downwardly therefrom into the soil area;

(d) said support legs extended downwardly and perpendicular to said top wall member and transverse to the longitudinal axis of said top wall member, whereby the waste water can flow freely laterally of said top wall member starting at a position below a lower surface of said top wall member into the adjacent soil area which is of a generally solid clay type composition; and (e) said support leg members have downwardly, inwardly inclined end walls to permit waste water flow longitudinally of said conduit structure about said end walls and through said drainage hole.

3. A conduit structure as described in claim 2, wherein:

(a) said top wall member having a septic inlet piping assembly connected thereto to convey septic tank waste water to an interior and centrally of said main body assembly; and (b) said conduit structure having spaced transfer members anchored to said top wall member, whereby said transfer members are to be grasped to transfer and move the entire said conduit structure to the proper location.

* * * * *